United States Patent [19]

Brill et al.

[11] Patent Number: 4,662,118

[45] Date of Patent: May 5, 1987

[54] GRINDING MACHINE

[75] Inventors: Jürgen Brill; Roland Schemel, both of Stuttgart, Fed. Rep. of Germany

[73] Assignee: Schaudt Maschinenbau GmbH, Stuttgart, Fed. Rep. of Germany

[21] Appl. No.: 708,265

[22] Filed: Mar. 5, 1985

[30] Foreign Application Priority Data

Mar. 22, 1984 [DE] Fed. Rep. of Germany ..... 3410451

[51] Int. Cl.[4] ..... B24B 5/26; B24B 5/16

[52] U.S. Cl. ..... 51/48 R; 51/165.87; 51/105 EC; 51/105 SP; 51/281 C; 51/289 R; 51/268

[58] Field of Search ..... 51/48 R, 165.87, 105 EC, 51/105 SP, 262, 281 C, 289 R, 215 CP, 165.75, 165.76, 165.77, 268, 272; 248/638

[56] References Cited

U.S. PATENT DOCUMENTS

| | | | |
|---|---|---|---|
| 1,817,405 | 8/1931 | Braren | 51/281 P |
| 3,271,910 | 9/1966 | Haisch | 51/105 SP |
| 3,327,432 | 6/1967 | Lockwood | 51/165.87 |
| 3,344,559 | 10/1967 | Seiuemon et al. | 51/105 |
| 4,024,674 | 5/1977 | Suzuki | 51/268 |
| 4,197,679 | 4/1980 | Yamada et al. | 51/105 EC |
| 4,324,452 | 4/1982 | Noguchi et al. | 248/638 |
| 4,365,446 | 12/1982 | Munekata | 51/268 |
| 4,417,422 | 11/1983 | Redeker et al. | 51/50 R |
| 4,551,048 | 11/1985 | Phillips | 51/101 R |

FOREIGN PATENT DOCUMENTS 2213088 11/1973 Fed. Rep. of Germany .

*Primary Examiner*—Frederick R. Schmidt
*Assistant Examiner*—Bradley I. Vaught
*Attorney, Agent, or Firm*—Peter K. Kontler

[57] ABSTRACT

A cam grinding machine wherein the slide which supports the grinding wheel need not support the motor which rotates the grinding wheel so that the inertia of the slide is low and the slide can be reciprocated toward and away from the rotating workpiece at a high frequency, without risking the development of sympathetic vibrations, in order to account for changes in the angular position of the workpiece and, if necessary, also for wear upon and for dressing of the grinding wheel. The motor for the grinding wheel is mounted on a carriage which supports the slide or is mounted on the bed of the grinding machine next to the slide for reciprocatory movement toward and away from the workpiece.

31 Claims, 5 Drawing Figures

GRINDING MACHINE

BACKGROUND OF THE INVENTION

The present invention relates to grinding machines in general, and more particularly to improvements in grinding machines which can be used for the treatment of workpieces having an at least partially non-circular outline, for example, camshafts for use in the engines of motor vehicles.

A cam grinding machine is disclosed in U.S. Pat. No. 3,344,559 to Seiuemon Inaba et al. The movements of the carriage for the grinding wheel of the patented machine are numerically controlled, i.e., the carriage is automatically moved toward and away from the workpiece in order to enable the working surface of the grinding wheel to adequately treat the entire camshaft including those portions whose radii of curvature are constant as well as those portions which constitute lobes. The carriage for the spindle of the grinding wheel further supports the prime mover which rotates the grinding wheel as well as a dressing apparatus for the working surface of the grinding wheel. Thus, the combined mass of the carriage and of the components which are mounted thereon is very pronounced, and this creates problems when the speed of such machines is to be increased in order to increase their output per unit of time. This is achieved by increasing the speed at which the workpiece is rotated about its axis during treatment by the working surface of the grinding wheel. When the rotational speed of the workpiece reaches a certain value, the characteristic frequency of the control system (which increases with the increasing angular velocity of the workpiece) and the characteristic frequency of the mechanical unit including the carriage and the prime mover for the spindle of the grinding wheel can reach a range of resonances at which the grinding wheel performs uncontrollable vibratory movements. This, in turn, prevents the machine from treating a rapidly rotating camshaft or an analogous workpiece with a required degree of accuracy In addition, and due to relatively large mass of the carriage and of the parts which are mounted thereon, it is necessary to employ extremely accurate controls as well as very rigid and sturdy parts, even at relatively low angular velocities of the workpiece, in order to ensure that the treatment will be carried out with a required degree of accuracy.

OBJECTS AND SUMMARY OF THE INVENTION

An object of the invention is to provide a novel and improved grinding machine which is constructed and assembled in such a way that vibrations cannot interfere with the accuracy of treatment of partially non-circular rotary workpieces even if such workpieces are rotated at a high speed or an extremely high speed.

Another object of the invention is to provide a novel and improved mounting for the means which are used in a cam grinding or like machine to drive one or more grinding wheels.

A further object of the invention is to provide a grinding machine wherein sympathetic vibrations of the mechanical system including the reciprocable support for the grinding wheel cannot develop even if the machine is to turn out large or extremely large numbers of workpieces per unit of time, i.e., even if the workpieces must be rotated at a high speed.

An additional object of the invention is to provide a grinding machine which can treat camshafts or analogous workpieces with a higher degree of accuracy than heretofore known cam grinding machines.

Still another object of the invention is to provide a grinding machine wherein the combined weight of the means for reciprocating the grinding wheel relative to a rotating workpiece and of components which are mounted on such reciprocating means can be reduced to a fraction of the weight of heretofore known reciprocating means without adversely affecting the transmission of torque to the grinding wheel.

Another object of the invention is to provide novel and improved means for dressing the grinding wheel in a machine of the above outlined character.

A further object of the invention is to provide novel and improved means for transmitting motion to the arrangement which is used in the above outlined machine to reciprocably support the spindle for the grinding wheel.

Another object of the invention is to provide a highly versatile grinding machine whose operation can be automated to any desired extent and wherein the exposed surface of the grinding wheel is shielded in a novel and improved way.

The improved machine is designed to grind rotary workpieces having an at least partially non-circular outline, such as cams and camshafts. In accordance with a feature of the invention, the machine comprises a support (e.g., a base or bed), a work holder which is mounted on the support and serves to support at least one workpiece for rotation about a predetermined axis (the work holder is preferably reciprocable along its support in parallelism with the axis of the workpiece thereon), a carriage which is mounted on the support for reciprocatory movement along a path extending at least substantially radially of the predetermined axis, a preferably lightweight slide which is at least indirectly mounted on the support for reciprocatory movement in parallelism with the path for the carriage, means for reciprocating the slide relative to the workpiece on the holder, at least one grinding wheel which is rotatably mounted on the slide, and means for rotating the grinding wheel including a prime mover (such as a powerful variable-speed electric motor) which is installed on or in the carriage and means for transmitting torque from the prime mover to the grinding wheel. Thus, the prime mover is not mounted on and need not necessarily share the reciprocatory movements of the slide.

In accordance with a first embodiment of the invention, the slide is mounted on and is reciprocable relative to the carriage. The latter can be provided with a carrier, e.g., a bridge including a portion which overlies the slide and supports the prime mover. Vibration damping means can be interposed between the carrier and the carriage so as to prevent the transmission of vibrations from the prime mover to the carriage and thence to the slide on the carriage.

In accordance with another presently preferred embodiment of the invention, the slide is adjacent to the carriage and is mounted directly on the support, e.g., on a stationary upwardly extending column or an analogous extension of the support.

At least in the first embodiment of the improved grinding machine, the axes of the rotary output element of the prime mover and of the grinding wheel are parallel to each other and are preferably disposed at different levels. For example, such axes can be disposed in a common vertical or nearly vertical plane. The torque transmitting means preferably comprises a belt transmission.

If the slide is mounted on the aforementioned stationary extension of the support, the axis of the output element of the prime mover can be disposed at a level below the axis of the grinding wheel. In such grinding machine, the reciprocating means can comprise prime mover means (such as a reversible electric motor) on the support, a rotary feed screw which can be driven by the prime mover means in a clockwise or in a counterclockwise direction, and a nut which mates with the feed screw and is operatively connected with the slide so that the latter is moved toward or away from the predetermined axis in response to rotation of the feed screw in the corresponding direction. Such reciprocating means can further comprise a unit for reciprocating the slide toward and away from the predetermined axis independently of the prime mover means. The feed screw can be rotatably mounted in the extension of the support. The prime mover means is preferably designed to move the slide relative to the predetermined axis in order to compensate for wear upon the grinding wheel, and the aforementioned unit preferably comprises means for reciprocating the slide relative to the predetermined axis in dependency on changes in the angular position of the workpiece on the holder, i.e., to ensure that the working surface of the grinding wheel will properly treat each and every portion of the workpiece irrespective of the distance between such portion and the predetermined axis. The just mentioned unit can comprise second prime mover means which is operable to rotate the nut relative to the feed screw and to thereby move the slide in the axial direction of the feed screw. Thus, the slide can be reciprocated by the first prime mover means which is arranged to rotate the feed screw, and the slide can be reciprocated by the second prime mover means which is arranged to rotate the nut relative to the feed screw.

The just discussed embodiment of the improved grinding machine preferably further comprises means for reciprocating the carriage in synchronism with the slide, and such reciprocating means can comprise means for transmitting motion from the first prime mover means (preferably from the feed screw) to the carriage. The motion transmitting means can comprise a second feed screw which is rotatably mounted in or on the support, a nut which mates with the second feed screw and is operatively connected with the carriage, and means for transmitting torque between the two feed screws. Such torque transmitting means can comprise a second belt transmission.

The grinding machine further comprises signal generating means for monitoring the angular position of the workpiece on the holder and control means (e.g., a suitable electronic circuit or a computer) for operating the reciprocating means for the slide in response to signals from the monitoring means so that the slide is moved toward and away from the predetermined axis in dependency on changes in the angular position of that workpiece which is then supported by and rotates relative to the holder. If the slide is mounted on the carriage, the reciprocating means for the slide is arranged to move the slide relative to the carriage in response to signals from the monitoring means.

The carriage is or can be reciprocated relative to the support in order to compensate for wear upon the grinding wheel. To this end, the machine can comprise discrete means for reciprocating the carriage independently of the reciprocating means for the slide if the slide is mounted on the carriage, or the means for reciprocating the slide can be used to shift the carriage relative to the workpiece if the slide is mounted directly on the support. The means for reciprocating a carriage which reciprocably supports the slide can comprise a discrete prime mover, a feed screw which is rotatable by such discrete prime mover in a clockwise or in a counterclockwise direction, and a nut which meshes with the just mentioned feed screw and is operatively connected to the carriage. The reciprocating means for the carriage can receive signals from the control means which operates the reciprocating means for the slide.

The grinding machine can be provided with a shield for a portion of the grinding wheel, and such shield is preferably mounted on and shares the movements of the slide. The machine then preferably further comprises means for moving the shield relative to the slide so as to compensate for wear upon the grinding wheel and to maintain the shield at a selected distance from the adjacent portion of the grinding wheel. The machine can further comprise a hood for a second portion of the grinding wheel, and such hood is preferably mounted on the carriage.

A dressing apparatus for the grinding wheel can be mounted on the slide and is then reciprocable with the slide relative to the predetermined axis. Such apparatus can comprise a rotary or plate-like dressing tool and means for moving the dressing tool at least substantially at right angles to the axis of the grinding wheel. The dressing tool can be disposed at a level above the grinding wheel or at another location, e.g., at the three or nine o'clock position of the grinding wheel if the latter is arranged to rotate about a substantially horizontal axis.

The dressing apparatus can be mounted on the carriage and can include a plate-like or an otherwise configurated dressing tool and means for moving the tool toward and away from the working surface of the grinding wheel. The moving means can include means for moving the dressing tool at least substantially at right angles to the axis of the grinding wheel. If the machine is designed to treat workpieces of the type having first portions disposed at a constant distance from the predetermined axis and second portions (e.g., lobes of cams) disposed at a different second distance from the predetermined axis and alternating with the first portions (as considered in the circumferential direction of the workpiece on the holder), the aforementioned signal generating monitoring means is preferably used to transmit signals to the control means which operates the moving means for the dressing tool so as to maintain the tool in engagement with the working surface of the grinding wheel while the latter treats a first portion of the workpiece on the holder, i.e., a portion each part of which is disposed at one and the same distance from the predetermined axis. The means for moving the dressing tool can comprise a reversible prime mover, a second carriage which supports the dressing tool, ways provided for the second carriage on the first mentioned carriage to guide the second carriage for movement at least substantially radially of the grinding wheel, and means (e.g., a feed screw) for moving the second carriage and the dressing tool thereon along such ways in response to operation of the reversible prime mover by the control means.

The novel features which are considered as characteristic of the invention are set forth in particular in the appended claims. The improved grinding machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
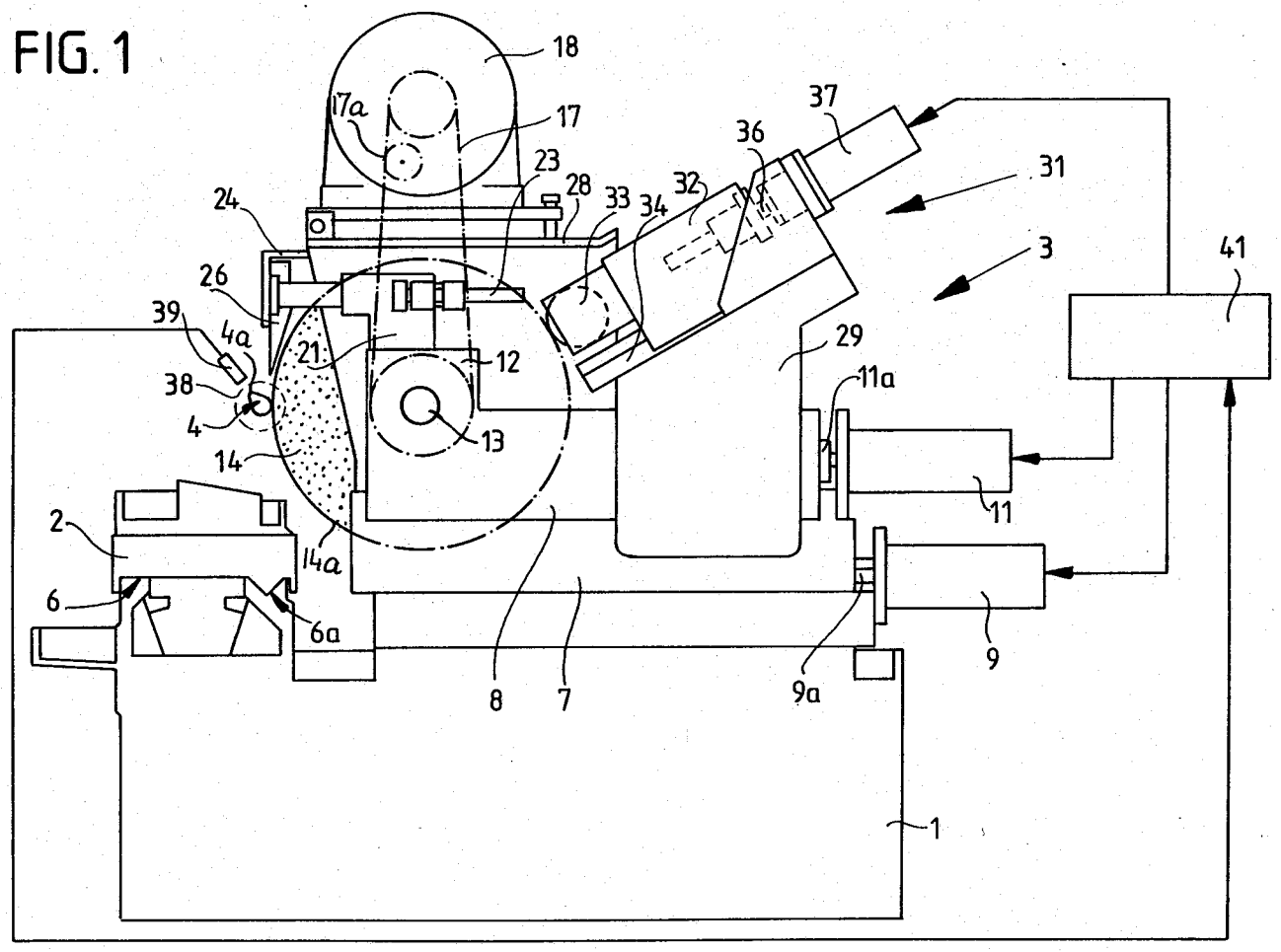
FIG. 1 is a schematic side elevational view of a grinding machine which embodies one form of the invention and wherein the slide for the spindle which drives the grinding wheel is reciprocably mounted on a carriage is reciprocable relative to the workpiece.
Figure 2:
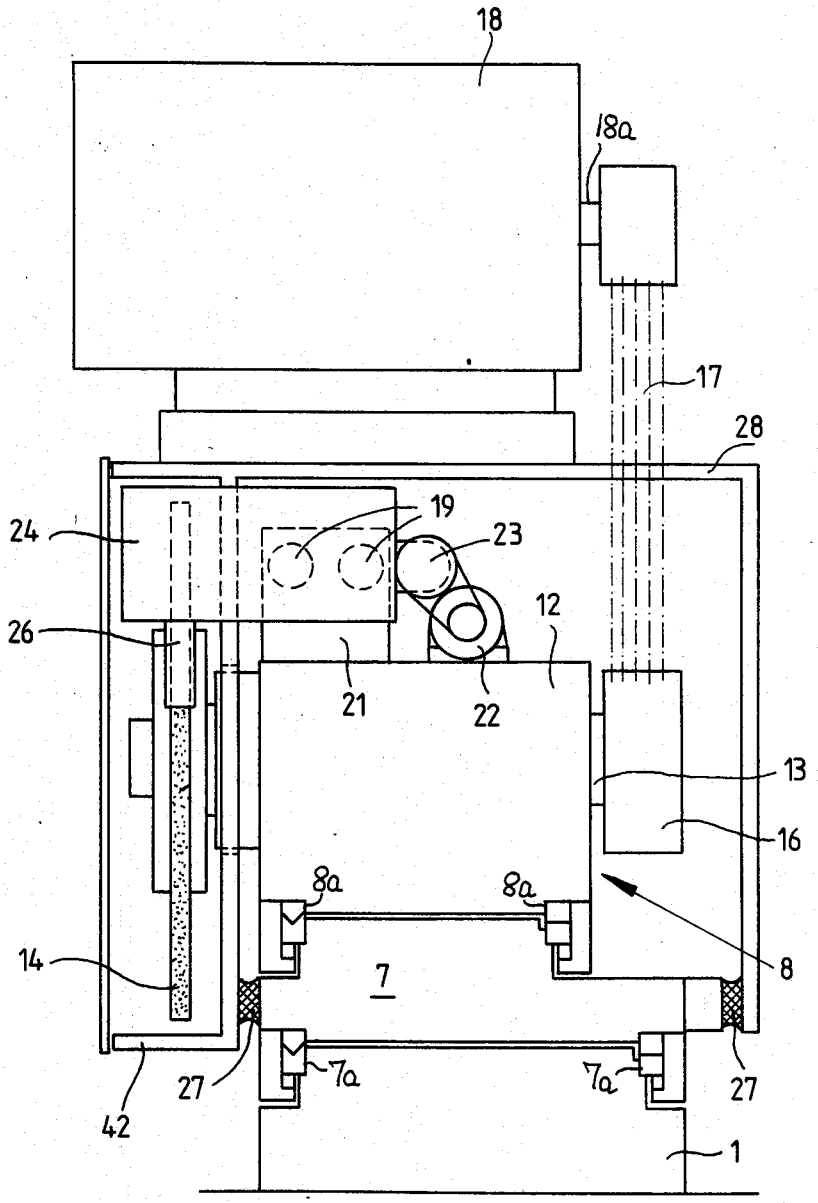
FIG. 2 is a front elevational view of the machine as seen from the left-hand side of FIG. 1, with the work holder and the workpiece omitted.

FIGS. 1 and 2 illustrate certain details of a machine for grinding rotary workpieces of the type having an at least partially non-circular outline. Typical examples of such workpieces are camshafts for use in internal combustion engines. One such workpiece is shown somewhat schematically at 4 in the left-hand portion of FIG. 1; such workpiece is assumed to constitute a camshaft with several lobes 4*a* (only one can be seen in FIG. 1).

The machine of FIGS. 1 and 2 comprises a support 1 in the form of a base or bed, a work holder 2 in the form of a table which is reciprocable along horizontal ways 6 and 6*a* provided therefor on the support 1 and extending at right angles to the plane of FIG. 1, and a grinding unit 3 which is reciprocable along the support 1 at right angles to the axis of the workpiece 4 which is mounted on the work holder 2. The means for rotatably supporting the workpiece 4 (or two or more coaxial workpieces) on the work holder 2 and for rotating the thus supported workpiece is mounted on the work holder but is not specifically shown because its construction can be the same as that of such supporting and rotating means in any one of a number of heretofore known and presently used grinding machines. Reference may be had, for example, to the aforementioned U.S. Pat. No. 3,344,559 to Seiuemon Inaba et al.

The grinding unit 3 comprises a carriage 7 which is reciprocable along ways 7*a* provided on the support 1 and defining a horizontal path extending at right angles to the direction of reciprocatory movement of the work holder 2 along the ways 6, 6*a* and at right angles to the axis of the workpiece 4 on the work holder, and a slide 8 which is indirectly mounted on the support 1 by being reciprocable along ways 8*a* provided therefor on the carriage 7 and extending in parallelism with the ways 7*a*, i.e., at right angles to the axis of the workpiece 4. The ways 7*a* and 8*a* can also be mounted in such a way that they make an oblique angle with the axis of the workpiece 4 on the work holder 2.

The means for reciprocating the carriage 7 along the ways 7*a* comprises a prime mover 9 (e.g., a reversible electric motor) and a rotary feed screw 9*a* which is rotated by the prime mover 9 and meshes with a nut (not specifically shown) on or in the carriage 7. The prime mover 9 is mounted on the support 1. The means for reciprocating the slide 8 relative to the carriage 7 and the workpiece 4 in the work holder 2 comprises a prime mover 11 (e.g., a reversible electric motor) which is mounted on the carriage 7 and whose output element constitutes or drives a short and sturdy feed screw 11*a* which meshes with a nut (not shown) of the slide 8. It will be seen that the slide 8 shares all reciprocatory movements of the carriage 7 relative to the workpiece 4 but that it can be moved independently of the carriage 7 in the same directions, namely toward and away from the workpiece.

The slide 8 supports a rotary spindle 13 which carries one or more grinding wheels. In the illustrated embodiment, the spindle 13 drives a single grinding wheel 14. The manner in which a spindle can support a set of two or more coaxial grinding wheels is disclosed, for example, in U.S. Pat. No. 4,417,422 to Werner Redeker et al. The spindle 13 is rotatable in a bearing block 12 which is mounted on or forms part of the slide 8. The right-hand end portion of the spindle 13, as viewed in FIG. 2, carries a single-groove or multiple-groove pulley 16 or a set of several coaxial pulleys for a set of endless belts 17 constituting a torque transmitting belt transmission between the spindle 13 (i.e., the grinding wheel 14) and the output element 18*a* of a prime mover 18 (e.g., a variable-speed electric motor) which is indirectly mounted on the carriage 7. Thus, the means for rotating the grinding wheel 14 includes a prime mover (18) which is not mounted on the slide 8, i.e., on that reciprocable part which rotatably supports the grinding wheel.

The prime mover 18 is mounted on the topmost portion of a carrier 28 in the form of a bridge which is supported by the carriage 7 in such a way that the axis of the output element 18*a* is parallel to and is located at a level above the axis of the grinding wheel 14. The grinding machine comprises vibration damping means 27 which are interposed between the carrier 28 and the carriage 7; such vibration damping means can comprise blocks made of rubber or another suitable elastomeric material. The axes of the output element 18*a* and grinding wheel 14 are disposed in a common plane which is vertical or substantially vertical. This is desirable and advantageous because it ensures that the distance between the axes of the output element 18*a* and grinding wheel 14 varies very little when the slide 8 is shifted along the ways 8*a* to move relative to the carriage 7. Such shifting is necessary only to ensure that the peripheral working surface 14*a* of the grinding wheel 14 can move toward and away from the axis of the workpiece 4 on the work holder 2 through relatively short distances matching the distance between the base circle of the workpiece 4 and the apex of the largest lobe or lobes 4*a*. In other words, the extent of reciprocatory movement of the slide 8 relative to the carriage 7 need not exceed the throw of the largest lobe on the workpiece 4. This feature (namely the shortness of the distances which the slide 8 must cover relative to the carriage 7)

renders it possible to mount the prime mover 18 on the carriage 7 without adversely influencing the transmission of torque from the output element 18*a* to the pulley or pulleys 16 on the spindle 13 for the grinding wheel 14. If desired or necessary, the bridge-like carrier 28 and/or the housing of the prime mover 18 can support tensioning elements 17*a* (e.g., spring-biased pivotably mounted rollers) for the belts of the transmission 17.

The bearing block 12 for the spindle 13 supports two elongated parallel tie rods 19 whose axes are normal to the axis of the grinding wheel 14 and which support a shield 24 for the upper front portion of the working surface 14*a* of the grinding wheel 14. The tie rods 19 are reciprocable in a bearing 21 which is mounted on or forms part of the block 12 and such tie rods are reciprocable by a driving unit including a prime mover 22 (e.g., a reversible electric motor) and a feed screw 23 which is rotatable by the prime mover 22 and mates with a nut (not shown) connected to the two tie rods. The shield 24 is adjacent to a coolant-discharging nozzle 26 which is mounted on the shield or on the tie rods 19. The prime mover 22 is or can be driven by the control circuit 41 of the grinding machine so that it is located at a fixed distance from the nearest portion of the working surface 14*a* irrespective of the wear upon the grinding wheel 14. The same holds true for the nozzle 26.

The slide 8 is preferably a lightweight component so that its inertia is as low as possible. The inertia of those parts (spindle 13, grinding wheel 14, shield 24 and nozzle 26) which are supported by the slide 8 is also low. In accordance with a preferred embodiment of the invention, the slide 8 does not support any other parts so that its inertia is surprisingly low to thus ensure that the reciprocating means including the prime mover 11 and the feed screw 11*a* can change the position of the slide relative to the carriage 7 practically without any delay when it becomes necessary to change the position of the grinding wheel 14 relative to the workpiece 4 in those angular positions of the workpiece when the working surface 14*a* must remove material from a lobe 4*a*.

The carriage 7 further supports a second carrier or bridge 29 which, in turn, supports a dressing apparatus 31. The latter comprises a carriage 32 which is reciprocable at right angles to the axis of the grinding wheel 14. That end portion of the carriage 32 which is nearest to the working surface 14*a* carries a dressing tool 33 (e.g., a rotatable wheel) which can treat the working surface 14*a*, preferably during each revolution of the workpiece 4 about its axis. The second carrier or bridge 29 supports ways 34 for the carriage 32 as well as means for reciprocating the carriage 32 along such ways. The reciprocating means comprises a prime mover 37 (e.g., a reversible electric motor) and a feed screw 36 which is driven by the prime mover 37 and mates with a nut (not shown) of the carriage 32.

The grinding machine further comprises a device for monitoring the angular position of the workpiece 4 relative to its holder 2. In the embodiment of FIGS. 1 and 2, the monitoring device comprises a disc 38 which rotates with the workpiece 4 and can be provided with one or more annuli of suitably distributed permanent magents or the like travelling past a proximity detector 39 whose output is connected to the corresponding input of the control circuit 41. The outputs of the control circuit 41 are connected with the inputs of the prime movers 9, 11 and 37, preferably also with the input of the prime mover 22.

The operation is as follows:

The workpiece 4 is installed in the holder 2 and is rotated by its drive whereby the monitoring device 38, 39 generates signals denoting the momentary angular positions of the workpiece. The workpiece 4 can be rotated at a constant speed or at a variable speed. It is clear that the illustrated monitoring device 38, 39 constitutes but one of numerous devices which can be employed to indicate the angular positions of the workpiece 4 on the holder 2 by transmitting appropriate signals to the control circuit 41. The latter transmits control signals to the prime mover 11 which causes the slide 8 to move relative to the workpiece 4 through the medium of the feed screw 11*a*. The extent of movement of the slide 8 relative to the carriage 7 in response to signals from the control circuit 41 to the prime mover 11 depends on the momentary angular position of the workpiece 4, namely whether the working surface 14*a* treats the cylindrical or a non-circular portion of the workpiece 4. FIG. 1 shows the workpiece 4 in an angular position in which the working surface 14*a* removes material from a portion which is close to the base circle, namely a portion of a lobe 4*a* whose center of curvature is located on the axis of the workpiece. Therefore, the working surface 14*a* is located at a minimum distance from such axis. When the angular position of the workpiece 4 is changed so that the working surface 14*a* removes material from a lobe 4*a* in the region where the radius of curvature of the lobe is greater than the minimum radius, the prime mover 11 causes the slide 8 to move away from the axis of the workpiece through a distance which is determined by the signal then transmitted by the proximity detector 39, i.e., by the momentary angular position of the workpiece. The slide 8 is located at a maximum distance from the axis of the workpiece 4 when the working surface 14*a* treats the apex of a lobe 4*a*. The distance between the slide 8 and the workpiece 4 thereupon begins to decrease and reaches a minimum value when the working surface 14*a* again treats a portion of the workpiece which is located at a minimum distance from the axis of the workpiece.

The position of the slide 8 relative to the carriage 7 and relative to the axis of the workpiece 4 remains unchanged for a relatively long interval of time when the working surface 14*a* treats the workpiece in the region of the base circle. Such interval can take longer than that which is required to rotate the workpiece 4 through 180 degrees and can be made even longer by rotating the workpiece at a lower speed while the surface 14*a* treats the portion which is located in the region of the base circle. In accordance with a feature of the present invention, the dressing tool 33 is caused to treat the working surface 14*a* during the just discussed interval. The signal from the corresponding output of the control circuit 41 to the input of the prime mover 37 causes the latter to rapidly advance the carriage 32 toward the grinding wheel 14 and the tool 33 is rapidly withdrawn from the working surface 14*a* as soon as the latter begins to treat a portion of the workpiece 4 which is located at a greater than minimum distance from the workpiece axis. The manner in which the speed of the drive for the workpiece 4 can be regulated (in order to ensure that the dressing tool 33 can remain in contact with the working surface 14*a* for a reasonably long interval of time which suffices to guarantee adequate dressing of the surface 14*a*) is known in the art and need not be described here. The signals for such reduction of angular velocity of the workpiece 4 can be transmitted from the control circuit 41 or directly from the proximity detector 39. The signal which is transmitted to the prime mover 37 to retract the carriage 32 for the dressing tool 33 is preferably used to return the carriage 32 to its fully retracted or starting position shortly or immediately before the distance between the axis of the grinding wheel 14 and the axis of the workpiece 4 begins to increase. The control circuit 41 includes appropriate evaluating means for the signals from the proximity detector 39 to thus ensure that the dressing tool 33 engages the working surface 14*a* at the very start of the interval (during each revolution of the workpiece) when the distance between the axes of the grinding wheel 14 and the workpiece remains unchanged and that the tool 33 is retracted by the prime mover 37 through the medium of the feed screw 36 and carriage 32 immediately prior to elapse of such interval.

The control circuit 41 further transmits appropriate signals to the prime mover 9 for the carriage 7 which reciprocably supports the slide 8 for the grinding wheel 14. The purpose of the carriage 7 is to compensate for wear upon the grinding wheel 14 as well as for the removal of material from the surface 14*a* by the dressing tool 33. Moreover, the carriage 7 serves to retract the grinding wheel 14 prior to replacement of a finished workpiece 4 with a fresh workpiece and/or prior to replacement of the illustrated grinding wheel 14 with a fresh or a different grinding wheel. Thus, oscillatory movements of the grinding wheel 14 toward and away from the axis of the workpiece 4 on the holder 2 for the purpose of ensuring adequate treatment of the surface of the workpiece (i.e., to account for the fact that different portions of the workpiece are located at different distances from its axis) are effected solely by the slide 8. The illustrated and described design of the improved grinding machine renders it possible to ensure that the slide 8 exhibits a relatively high characteristic frequency so that sympathetic vibrations as a result of oscillatory movements of the slide 8 relative to the carriage 7 do not develop at all. The short strokes of the slide 8 and the very rigid, very short and inertia-free feed screw 11*a* also contribute to prevention of such sympathetic vibrations. Oscillations of the prime mover 18 due to imbalance (such oscillations cannot always be avoided in their entirety without an excessive outlay) cannot adversely affect the accuracy of treatment of the workpiece 4 on the holder 2 because the carrier 28 for the prime mover 18 is mounted on the carriage 7 through the medium of vibration damping means 27.

The grinding machine of FIGS. 1 and 2 further comprises a hood 42 which shields the major part of the exposed portion of the working surface 14*a* and is mounted on the carrier 28 for the prime mover 18. The hood 42 cooperates with the shield 24 to reduce the likelihood of injury to the operators and/or splashing of coolant when the machine is in use. As mentioned above, the shield 24 is adjustable so as to compensate for wear upon the grinding wheel 14 as a result of engagement with workpieces as well as due to the dressing action of the tool 33. The prime mover 22 which effects such adjustments can receive signals from the control circuit 41 or it can be started or arrested by hand. Furthermore, it is possible to replace the motor 22 with a manually operated device which can be actuated at required intervals to change the position of the shield 24 and nozzle 26 relative to the working surface 14*a*. The just discussed manually operated device can be used in addition to or in lieu of the prime mover 22. All that counts is to ensure that the exposed part of the working surface 14*a* is adequately shielded irrespective of the extent of wear upon the grinding wheel 14.

The holder 2 is moved relative to the support 1 whenever the treatment of a section of the workpiece 4 is completed. As can be seen in FIG. 2, the axial length (thickness) of the grinding wheel 14 is or can be relatively small so that the treatment of a relatively long workpiece is then carried out in a number of successive stages.

It has been found that the characteristic frequency of the mechanical system including the slide 8 and the reciprocating means 11, 11*a* for the slide is increased to such an extent that a resonance at the frequency of the recurrent linear movements of the slide 8 for the purpose of accounting for changes in the angular position of the workpiece 4 on the holder 2 (such movements are initiated by the control circuit 41 and serve to ensure that the working surface 14*a* of the grinding wheel 14 can properly treat all portions of the workpiece irrespective of their distance from the axis of rotation of the workpiece in the holder 2) is impossible. Thus, the mechanical system cannot develop sympathetic vibrations and, therefore, rapidly recurring reciprocatory movements of the slide 8 toward and away from the axis of the workpiece 4 on or in the holder 2 cannot adversely influence the accuracy of finish of the workpiece.

The machine of FIGS. 1 and 2 is surprisingly compact because the slide 8 is mounted directly on the carriage 7. The prime mover 18 cannot adversely influence the accuracy of treatment of the workpiece 4 on the holder 2 in spite of the fact that the prime mover is mounted on the carriage 7 because the carrier 28 for the prime mover 18 is secured to the carriage 7 through the medium of the vibration damping means 27. This holds true even if the output element 18*a* of the prime mover 18 rotates out of true.

The provision of discrete reciprocating means (9, 9*a* and 11, 11*a*) for the carriage 7 and slide 8 is desirable and advantageous in the machine of FIGS. 1 and 2 because the machine can employ a relatively simple control circuit. This is due to the fact that shifting of the grinding wheel 14 relative to the axis of the rotating workpiece 4 on or in the holder 2 for the purpose of compensating for wear upon the grinding wheel (as a result of engagement with the workpieces and/or as a result of treatment by the dressing tool 33) is independent of reciprocatory movements of the grinding wheel 14 in response to signals from the monitoring means 38, 39, i.e., in response to movements which are carried out in order to ensure that the workpiece 4 can be adequately treated in each of its angular positions.

The provision of the shield 24 and of the hood 42 insures that the grinding wheel 14 is properly concealed at all times irrespective of the extent of wear upon its working surface 14*a*. Moreover, and since the slide 8 merely carries the lightweight shield 24 (the hood 42 is mounted on the carriage 7), the provision of combined shielding means 24, 42 does not contribute significantly to the bulk of parts which reciprocate with the slide 8.

Figure 3:
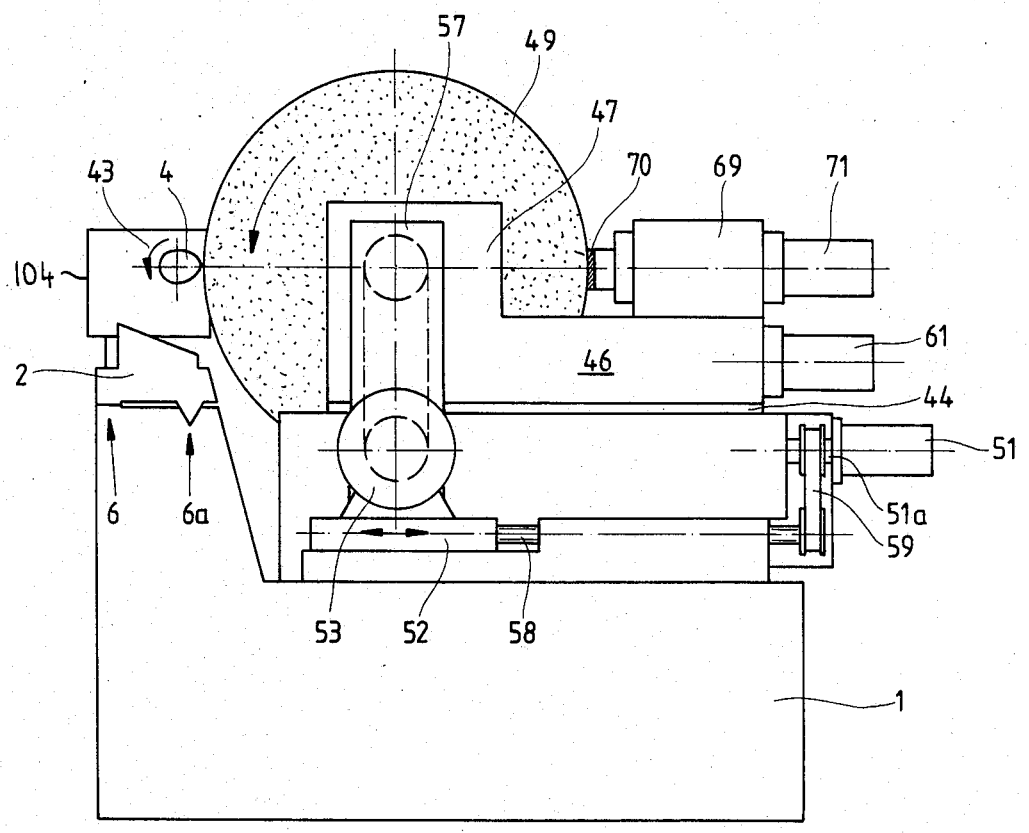
FIG. 3 is a schematic side elevational view of a second machine wherein the slide for the spindle which drives the grinding wheel is mounted directly on the support and wherein the dressing tool is disposed at a level below the apex of the grinding wheel.
Figure 4:
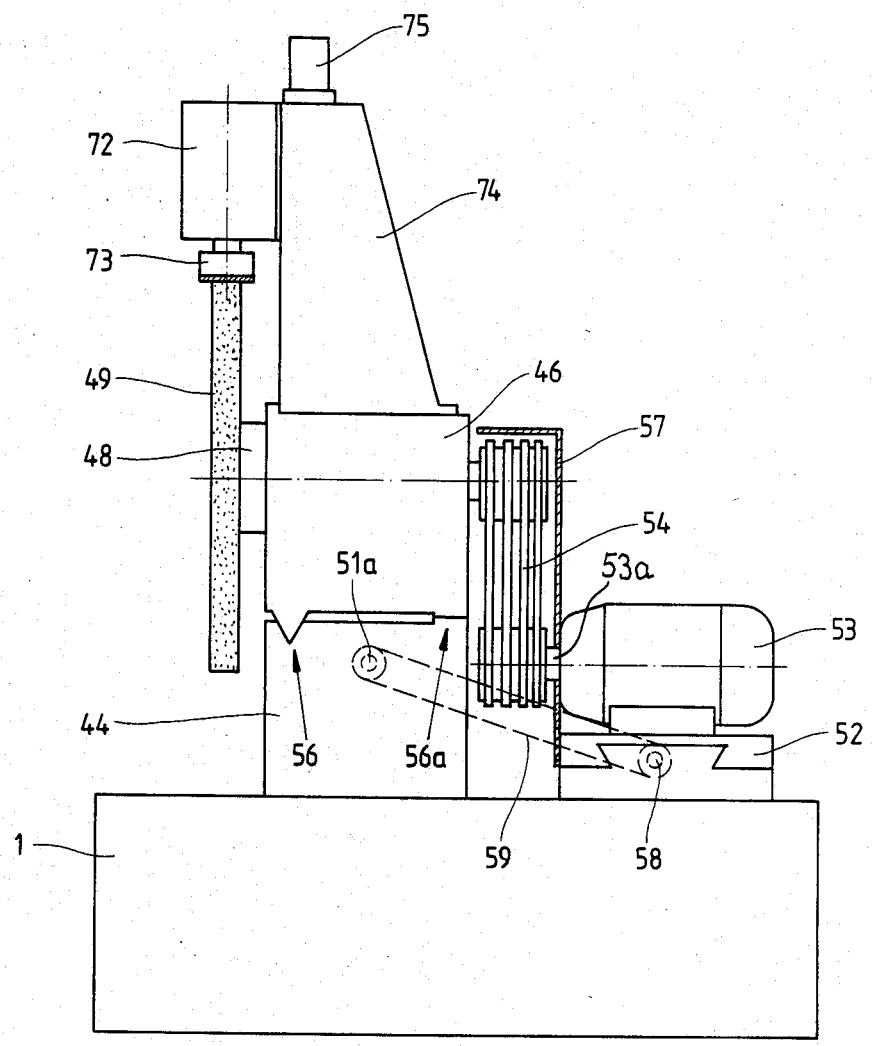
FIG. 4 is a front elevational view of the machine which is shown in FIG. 3 but with a modified dressing apparatus whose tool is disposed above the apex of the grinding wheel.
Figure 5:
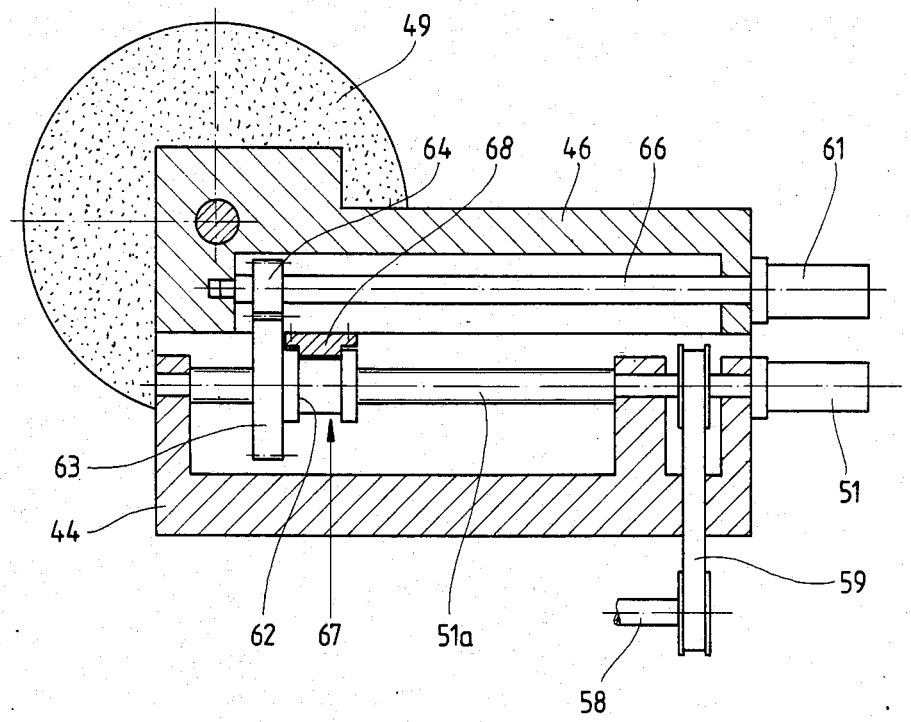
FIG. 5 is an enlarged view of a detail in the machine of FIG. 3, with a portion of the support and the slide for the spindle which drives the grinding wheel shown in a vertical sectional view.

FIGS. 3, 4 and 5 illustrate a second embodiment of the improved grinding machine. FIG. 4 further shows a slight modification of such second embodiment. The machine of FIGS. 3 to 5 again comprises a support 1 in the form of a base or bed, a work holder 2 which is reciprocable along parallel horizontal ways 6, 6*a* provided on the support 1 and extending at right angles to the plane of FIG. 3, means 104 provided on the holder 2 for rotatably supporting at least one workpiece 4 so that the axis of the workpiece which is properly mounted on the holder 2 is parallel to the ways 6, 6*a*, and a drive for rotating the workpiece 4 in the direction of arrow 43. The support 1 includes a stationary extension 44 in the form of a column which directly supports a slide 46 corresponding to the slide 8 of the grinding machine shown in FIGS. 1 and 2. Thus, the slide 46 is mounted directly on the support 1 rather than on a carriage 52 which is reciprocable on the support in parallelism with the slide 46 at right angles to the axis of the workpiece 4 on the holder 2. The slide 46 supports a bearing block 47 for the spindle 48 which carries one or more grinding wheels 49 (FIGS. 3 to 5 merely show a single grinding wheel on the spindle 48). The means for reciprocating the slide 46 comprises a prime mover 51 (e.g., a reversible electric motor) which transmits motion to the slide through the medium of a feed screw 51*a* mating with a nut that shares the movements of the slide. The feed screw 51*a* is installed in the stationary extension 44 of the support 1.

The carriage 52 supports a prime mover 53 (e.g., a variable-speed electric motor) which transmits torque to the spindle 48 for the grinding wheel 49 through the medium of a belt transmission 54 which is confined within a cover 57 supported by the carriage 52. The axis of the spindle 48 is located at a level above the prime mover 53; this can be readily seen in FIG. 4. Such mounting of the transmission 54 (so that the tension of its belts acts in a direction from the spindle 48 and downwardly toward the prime mover 53) is desirable and advantageous because it stabilizes the position of the slide 46 on its parallel ways 56 and 56*a*.

The carriage 52 is reciprocable by a drive including the prime mover 51, the feed screw 51*a* and a further feed screw 58 which receives torque from the feed screw 51*a* through the medium of a belt transmission 59. This ensures that the carriage 52 is reciprocable parallel to and in synchronism with the slide 46. Such synchronization brings about the advantage that the distance between the axis of the grinding wheel 49 (and spindle 48) and the axis of the output element 53*a* of the prime mover 53 remains unchanged in all positions of the slide 46 with reference to the axis of the workpiece 4 on the holder 2.

The means for reciprocating the slide 46 relative to the workpiece 4 on the holder 2 comprises an additional prime mover 61 (e.g., a reversible electric motor) whose operation will be explained with reference to FIG. 5. The prime mover 51 rotates the feed screw 51*a* which is mounted in the stationary extension 44 of the support 1 and meshes with a nut 62. The latter transmits motion to the slide 46 which is reciprocable in parallelism with the feed screw 51*a*. FIG. 5 further shows the belt transmission 59 which transmits torque from the feed screw 51*a* to the feed screw 58 for the carriage 52.

The nut 62 is non-rotatably connected with a gear 63 which mates with a gear 64. The gear 64 is rotatably mounted in the slide 46 and receives torque from the prime mover 61 through the medium of a shaft 66. The nut 62 has or is connected with an annular follower 67 cooperating with an entraining element 68 of the slide 46. Thus, the mating gears 63, 64 can rotate the nut 62 when the prime mover 61 is on whereby the nut 62 and the slide 46 move axially of the feed screw 51*a*. The grinding wheel 49 is moved radially of the axis of the workpiece 4 (toward engagement with the workpiece as well as to compensate for wear upon and for dressing of the grinding wheel) when the prime mover 61 is idle, i.e., when the gear 64 does not rotate the nut 62 through the medium of the gear 63, namely when the prime mover 51 is on to rotate the feed screw 51*a*. The slide 46 is moved (in order to account for the absence of roundness of the workpiece 4) when the prime mover 61 is on to rotate the nut 62 by way of the shaft 66 and gears 64, 63. This movement of the slide 46 is superimposed upon the movement which is initiated by the prime mover 51.

The slide 46 is a relatively lightweight component of the grinding machine and it does not carry any heavy aggregates. This ensures that the slide 46 cannot perform any sympathetic vibrations and can be moved relative to the axis of the workpiece 4 at a high speed to guarantee that the working surface of the grinding wheel 49 can properly treat the rotating workpiece.

FIG. 3 shows that a dressing apparatus 69 with a dressing tool 70 for the working surface of the grinding wheel 49 is mounted on the slide 46. The prime mover 71 (e.g., a reversible electric motor) for the carriage (not specifically shown) which supports the tool 70 can remain in operation during each stage of each revolution of the workpiece because the dressing apparatus 69 is mounted on the slide 46, i.e., on the part which carries the spindle 48 for the grinding wheel 49.

The machine of FIG. 4 is identical with that of FIG. 3 except that it utilizes a differently constructed and mounted dressing apparatus 72. The dressing tool 73 is disposed at a level above the grinding wheel 49 and the apparatus 72 is movably mounted on a frame 74 which is mounted on the slide 46. The means for feeding the tool 73 toward the grinding wheel 49 comprises a prime mover 75 on the frame 74.

The dressing tool 70 or 73 can be any one of a variety of commercially available tools, e.g., a plate-like tool which is fixedly secured to its carriage, a rotary roller- or wheel-shaped tool, a cupped rotary dressing tool and/or others.

Referring again to FIG. 5, the axial length of the gear 64 is such that it remains in mesh with the gear 63 in each position of the slide 46. The axial length of the gear 64 can exceed that of the gear 63 or vice versa. Alternatively, the gear 64 can be axially movably mounted on the shaft 66 (but continues to receive torque therefrom in each of its axial positions) so that it can remain in mesh with a relatively thin gear 63 or that it can constitute a thin gear in mesh with an equally thin or thicker gear 63.

The shield and the hood for the grinding wheel 49 have been omitted in FIGS. 3 to 5 for the sake of clarity. The hood as well as the shield can be mounted on the carriage 52 since the latter moves in synchronism with the slide 46 when the slide receives motion from the prime mover 51.

The machine of FIGS. 3 to 5 exhibits the advantage that the means for reciprocating the carriage 52 relative to the support 1 need not comprise a discrete prime mover, i.e., the carriage 52 can be reciprocated by one (51) of the prime movers (51, 61) for the slide 46.

German Offenlegungsschrift No. 2,213,088 discloses a numerically controlled grinding machine wherein the slide for the grinding wheel is mounted on a reciprocable carriage. The machine which is disclosed in this printed publication is utilized for the treatment of workpieces having cylindrical sections of different diameters. Moreover the entire means for rotating the grinding wheel is mounted on the slide and the latter is designed to carry additional aggregates. The grinding wheel is moved into material-removing engagement with the workpiece by moving the carriage for the slide and, at such time, the position of the slide on the carriage remains unchanged. When a grinding operation upon a cylindrical section of the workpiece is completed, the slide is moved relative to the carriage so as to account for the difference between the diameter of the finished cylindrical section and the next cylindrical section of the workpiece. This enables the numerically controlled machine to adequately treat cylindrical sections of a workpiece wherein the sections have different diameters without altering the information which is stored in the memory of the machine and pertains to the feeding of the grinding wheel against different sections of the workpiece. In other words, the purpose of the slide on the carriage is to allow for a simplification of numerical controls of the grindng machine. The just discussed machine cannot be used for the grinding of camshafts or analogous workpieces having non-cylindrical portions and the problems which are solved by mounting the slide on the numerically controlled carriage are not the same as those which are solved by the advent of the present invention, namely to allow for rapid grinding of camshafts or like workpieces without affecting the quality of the treatment, even when the workpiece or workpieces are caused to rotate at a very high speed. Vibrations and similar problems which arise when the grinding wheel must be rapidly reciprocated relative to a non-circular workpiece are not discussed in the German printed publication. This publication also fails to mention the possibility of using a reciprocable carriage as a means for shifting the grinding wheel relative to the workpiece through distances such as to compensate for wear upon the grinding wheel, and to use a separately movable slide as a means for reciprocating the grinding wheel relative to the workpiece for the purpose of ensuring that the working surface of the grinding wheel will be maintained at a requisite distance from the axis of the rotating workpiece in each and every angular position of the latter.

The improved grinding machine exhibits the important advantage that it can adequately treat camshafts and like workpieces even if the rotational speed of the workpieces during treatment is very high or extremely high, such as is necessary to ensure a high output, whereby the quality of the treated workpieces not only matches but even exceeds the quality of workpieces which are treated in heretofore known cam grinding machines. This is accomplished in that the improved machine is designed to prevent the development of sympathetic vibrations of the mechanical system including the spindle for the grinding wheel, the slide which supports such spindle and the means for reciprocating the slide. In other words, sympathetic vibrations cannot affect the grinding operation and the quality of treatment of the workpieces, even at high angular velocities. The slide of the improved grinding machine carries a minimal number of parts so that the combined inertia of the slide and of the parts which are mounted thereon is small; this renders it possible to reciprocate the slide at extremely high speeds relative to the carriage for the prime mover which drives the spindle for the grinding wheel. The slide must perform relatively short reciprocatory movements since such movements are performed exclusively to ensure that the working surface of the grinding wheel will be maintained at a required distance from the axis of the workpiece in dependency on the momentary angular position of the workpiece. Moreover, such mounting of the slide renders it possible to impart thereto reciprocatory movements relative to the carriage for the prime mover 18 or 53 by a feed screw or another motion transmitting element which is sturdy and rigid and whose inertia is low.

Another important advantage of the improved grinding machine is that, in spite of the need for frequent reciprocatory movements of the slide in order to account for changes in the angular position of a camshaft or an analogous workpiece, the working surface of the grinding wheel can be dressed continuously or during a substantial part of each revolution of the workpiece. This contributes to higher productivity and economy of the improved machine as well as to higher accuracy of treatment of the workpieces.

An additional important advantage of the improved grinding machine is that it can employ a large, heavy and strong prime mover for the spindle which drives the grinding wheel because such prime mover need not be mounted on the slide for the grinding wheel. Thus, the machine can employ a highly dynamic slide even though the grinding wheel on such slide is driven by a large and powerful motor. Furthermore, and at least in those embodiments wherein the dressing apparatus is not supported by the slide, the machine can employ a dressing apparatus which is sufficiently large to allow for effective, accurate and rapid treatment of the working surface of the grinding wheel. All of the above features are prerequisites to realistically expect an effective operation of numerically controlled grinding machines which are used to turn out large numbers of camshafts or like workpieces per unit of time.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A machine for grinding rotary workpieces having an at least partially non-circular outline, such as camshafts, comprising a support; a work holder mounted on said support and arranged to support at least one workpiece for rotation about a fixed axis; a carriage mounted on said support for reciprocatory movement along a path extending substantially radially of said axis; a lightweight slide at least indirectly mounted on said support for reciprocatory movement in parallelism with said path with and relative to said carriage; at least one grinding wheel rotatably mounted on said slide; means for reciprocating said slide relative to the workpiece on said work holder so as to maintain the tool in substantially continuous contact with the rotary workpiece in spite of the non-circular outline of the workpiece on the work holder; and means for rotating said grinding wheel, including a prime mover provided on said carriage and means for transmitting torque from said prime mover to said grinding wheel, said lightweight slide and the tool thereon being reciprocable with reference to said carriage and with reference to the prime mover on said carriage.

2. The machine of claim 1, wherein said slide is mounted on said carriage.

3. The machine of claim 2, further comprising a carrier provided on said carriage and supporting said prime mover.

4. The machine of claim 3, wherein said carrier comprises a bridge including a portion overlying said slide and supporting said prime mover.

5. The machine of claim 3, further comprising vibration damping means interposed between said carriage and said carrier.

6. The machine of claim 1, wherein said slide is adjacent to said carriage and is mounted directly on said support.

7. The machine of claim 1, wherein said prime mover comprises a rotary output element and the axes of said output element and said grinding wheel are parallel to and disposed one above the other.

8. The machine of claim 7, wherein the axes of said output element and said grinding wheel are disposed in a common substantially vertical plane.

9. The machine of claim 1, wherein said torque transmitting means comprises a belt transmission.

10. The machine of claim 1, wherein said support includes an extension and said slide is reciprocably mounted on said extension, said prime mover including a rotary output element and the axis of said output element being located at a level below the axis of said grinding wheel.

11. The machine of claim 10, wherein said torque transmitting means comprises a belt transmission.

12. The machine of claim 1, wherein said reciprocating means comprises prime mover means on said support, a rotary feed screw driven by said prime mover means, and a nut mating with said feed screw and operatively connected with said slide so that the latter is moved toward and away from said predetermined axis in response to rotation of said feed screw in the corresponding direction, said reciprocating means further comprising a unit for reciprocating said slide toward and away from said predetermined axis independently of said prime mover means.

13. The machine of claim 12, wherein said support includes an extension and said feed screw is rotatably mounted in said extension.

14. The machine of claim 12, wherein said prime mover means is operable to effect a movement of said slide relative to said predetermined axis in order to compensate for wear upon the grinding wheel and said unit includes means for reciprocating said slide relative to said predetermined axis in dependency on changes in the angular position of the workpiece on said holder.

15. The machine of claim 14, wherein said unit includes second prime mover means which is operable to rotate said nut relative to said feed screw and to thereby move said slide in the axial direction of said feed screw.

16. The machine of claim 12, further comprising means for reciprocating said carriage in synchronism with said slide including means for transmitting motion from said prime mover means to said carriage.

17. The machine of claim 16, wherein said motion transmitting means comprises a second feed screw rotatably mounted in said support, a nut mating with said second feed screw and operatively connected with said carriage, and means for transmitting torque between said feed screws.

18. The machine of claim 1, further comprising signal generating means for monitoring the angular position of the workpiece on said holder and control means for operating said reciprocating means in response to signals from said monitoring means so that said slide is moved toward and away from said predetermined axis in dependency on changes in the angular position of the workpiece on said holder.

19. The machine of claim 18, wherein said reciprocating means is arranged to move said slide relative to said carriage in response to signals from said monitoring means.

20. The machine of claim 1, further comprising means for reciprocating said carriage relative to said support in order to compensate for wear upon the grinding wheel.

21. The machine of claim 20, wherein the means for reciprocating said carriage comprises a second prime mover, a feed screw rotatable by said second prime mover, and a nut meshing with said feed screw and operatively connected with said carriage.

22. The machine of claim 20, further comprising control means operatively connected with and arranged to operate the reciprocating means for said slide and said carriage.

23. The machine of claim 1, further comprising a shield for a portion of said grinding wheel, said shield being provided on said slide.

24. The machine of claim 23, further comprising means for moving said shield relative to said slide so as to compensate for wear upon the grinding wheel and to maintain the shield at a selected distance from said portion of the grinding wheel.

25. The machine of claim 24, further comprising a hood for a second portion of said grinding wheel, said hood being provided on said carriage.

26. The machine of claim 1, further comprising a dressing apparatus for said grinding wheel, said apparatus being provided on and being reciprocable with said slide and including a dressing tool and means for moving said dressing tool at least substantially at right angles to the axis of the grinding wheel.

27. The machine of claim 26, wherein said tool is disposed at a level above said grinding wheel.

28. The machine of claim 1, further comprising an apparatus for dressing said grinding wheel, said apparatus being provided on said carriage and including a dressing tool and means for moving said tool toward and away from the grinding wheel.

29. The machine of claim 28, wherein said moving means includes means for moving said tool at least substantially at right angles to the axis of said grinding wheel.

30. The machine of claim 28 for grinding rotary workpieces of the type having first portions disposed at a constant distance from said predetermined axis and second portions disposed at at least one different second distance from said predetermined axis, said first and second portions alternating with each other as considered in the circumferential direction of the workpiece on said holder, and further comprising signal generating means for monitoring the angular position of the workpiece on said holder and control means for operating said moving means so as to maintain the dressing tool in engagement with the grinding wheel while the latter treats the first portions of the workpiece on said holder.

31. The machine of claim 30, wherein said moving means comprises a reversible prime mover, a carriage for said dressing tool, ways provided on said first named carriage to guide the carriage for said dressing tool for movement at least substantially at right angles to the axis of said grinding wheel, and means for moving the carriage for said dressing tool along said ways in response to operation of said reversible prime mover by said control means.

* * * * *